US008657217B2

(12) United States Patent
Lejosne

(10) Patent No.: US 8,657,217 B2
(45) Date of Patent: Feb. 25, 2014

(54) EQUIPMENT FOR PRODUCING GRANULES FROM PLANTS

(76) Inventor: Alain Lejosne, Venelles (FR)

( * ) Notice: Subject to any disclaimer, the term of this patent is extended or adjusted under 35 U.S.C. 154(b) by 374 days.

(21) Appl. No.: 13/002,414

(22) PCT Filed: Jul. 2, 2009

(86) PCT No.: PCT/FR2009/000820

§ 371 (c)(1),
(2), (4) Date: Apr. 1, 2011

(87) PCT Pub. No.: WO2010/000982

PCT Pub. Date: Jan. 7, 2010

(65) Prior Publication Data

US 2011/0168816 A1 Jul. 14, 2011

(30) Foreign Application Priority Data

Jul. 2, 2008 (FR) ..... 08 03747

(51) Int. Cl.
*B02C 23/20* (2006.01)

(52) U.S. Cl.
USPC ..... 241/65; 241/101.2; 241/138; 241/101.76

(58) Field of Classification Search
USPC ..... 241/23, 28, 24.2, 65, 138, 101.75, 241/101.76, 101.2
See application file for complete search history.

(56) References Cited

U.S. PATENT DOCUMENTS

| | | | |
|---|---|---|---|
| 4,112,587 | A | 9/1978 | Sundman |
| 4,528,037 | A | 7/1985 | Guidat |

FOREIGN PATENT DOCUMENTS

| | | | |
|---|---|---|---|
| DE | 3247303 | A1 | 7/1984 |
| FR | 2 340 517 | A1 | 9/1977 |
| GB | 1 211 144 | A | 11/1970 |
| JP | 2006-231712 | A | 9/2006 |

OTHER PUBLICATIONS

Int'l Search Report issued on Feb. 23, 2010 in Int'l Application No. PCT/FR2009/000820.
Written Opinion issued on Feb. 23, 2010 in Int'l Application No. PCT/FR2009/000820.
Int'l Preliminary Report on Patentability issued on Mar. 1, 2011 in Int'l Application No. PCT/FR2009/000820.

*Primary Examiner* — Mark Rosenbaum
(74) *Attorney, Agent, or Firm* — Panitch Schwarze Belisario & Nadel LLP

(57) ABSTRACT

Equipment for producing granules from a ligneous material includes a unit (LPGcont) for the continuous production of agglomerated plant particles, a unit (GAC) for the production of hot air from plants, the hot air being used for the production of the agglomerated particles, and also at least one mobile load-bearing structure to which the two production units are attached.

16 Claims, 8 Drawing Sheets

EQUIPMENT FOR PRODUCING GRANULES FROM PLANTS

CROSS-REFERENCE TO RELATED APPLICATIONS

This application is a Section 371 of International Application No. PCT/FR2009/000820, filed Jul. 2, 2009, which was published in the French language on Jan. 7, 2010, under International Publication No. WO 2010/000982 A2 and the disclosure of which is incorporated herein by reference.

BACKGROUND OF THE INVENTION

Embodiments of the present invention relate to equipment for producing granules from plants coming, in particular, in the form of slash, trunks, or branches.

French patent FR-A-2491491 describes equipment for transforming ligneous wastes into combustible granules which comprises: a boiler fed with grinded barks from a silo of grinded barks; a dryer fed with combustion gas of the boiler and/or cooling air of the boiler exchanger, and with humid sawdust, from a humid sawdust silo; a cyclone separator of sawdust and smoke; a dry sawdust silo linked through a dosing box, a grinder, an a mixer to a granule press, the output of which opens onto a cooling and screening machine pouring the granules into an elevator; and silos for storing the granules.

A drawback of such equipment is the significant dimensions thereof.

A mobile system for producing granules from branches and leaves has been described in Japanese patent JP-A-2006231712, which comprises a grinder, a dryer, and a device for producing granules. To the inventor's knowledge, this system does not make it possible however to process highly humid plants, or to process plants comprising flammable compounds such as "spirits of turpentine."

It is desirable to provide equipment for transforming plants into granules, the compactness of which is improved.

It is further desirable to provide equipment for producing granules from plants which is improved and/or solves, at least partially, the deficiencies or drawbacks of known devices for producing vegetal granules.

BRIEF SUMMARY OF THE INVENTION

According to one aspect of the invention, equipment is provided for processing a ligneous material and includes a unit for the production of agglomerated particles of the ligneous material as well as a unit for the production of hot air from the ligneous material. The hot air is used for drying the particles of the ligneous material. The two production units are mounted on one (or more) mobile elongated load-bearing structure(s).

According to another aspect of the invention, equipment is provided for processing plants and includes a dryer arranged to provide dry sawdust and a compactor arranged to provide dry sawdust granules, in which the input of the compactor is directly linked, i.e. without an intermediate silo, to the output of the dryer to receive therefrom the dry sawdust, and in which the dryer and the compactor are mounted on at least one mobile chassis arranged to rest—or resting—on the ground. The equipment for processing plants further includes a hot air generator having a source of heat, such as a furnace, and a structure for carrying air, such as a bundle of tubes, which is arranged to be heated by the source of heat while isolating from this source the air it carries, so as to avoid bringing particles or flammable compounds with the air carried by this structure.

In other words and according to another aspect of the invention, equipment is provided for the production of granules from plants that includes a dryer able to provide dry sawdust and a compactor able to provide dry sawdust granules, in which the dryer is arranged to substantially continuously provide the dry sawdust to the compactor, and in which the dryer and the compactor are mounted on at least one chassis able to rest—or resting—on the ground by means of feet or wheels.

In particular and according to another aspect of the invention, equipment is provided for the production of granules from slash, trunks, or branches. The equipment includes a first dryer able to dry chips, a grinder able to grind dried chips to provide sawdust, a second dryer able to dry sawdust and provide dry sawdust, and a compactor able to compact the dried sawdust and provide granules of dry sawdust, in which the first dryer performs a substantially continuous transfer of dried chips to the grinder, in which the grinder performs a substantially continuous transfer of grinded chips (sawdust) to the second dryer, in which the second dryer performs a substantially continuous transfer of dry sawdust to the compactor, and in which the first and second dryers, the grinder, and the compactor are mounted on at least one chassis able to rest—or resting—on the ground by means of retractable stabilizers or wheels.

According to another aspect of the invention, equipment according to claim 1 is provided.

Certain preferred embodiments of the invention are described below.

The equipment may further include a shredder able to shred slash, trunks, or branches, and to produce chips. The shredder is preferably mounted on the chassis.

The equipment may further include a granule cooler which is fed by the compactor and allows cooled granules to be provided to a packing or evacuation station. The cooler is preferably mounted on the chassis.

The dryer(s), and in that event the cooler, may include an elongated hollow cylinder body rotatively mounted (in relation to the chassis) according to its longitudinal axis which is substantially horizontal, i.e. slightly leaning in relation to a horizontal plane. The hollow body delineates a transfer tubular enclosure able to contain the chips—or sawdust—to be dried (respectively the granules to be cooled). The internal face of the wall of the hollow body delineating the tubular enclosure is preferably provided with projecting portions spreading along a line in helix which axis is substantially the same as the longitudinal axis of the hollow body. These projecting portions make it possible to cause, by the rotation of the hollow body according to its axis, the transfer along this axis of the particles—chips, sawdust, or granules—contained in the tubular enclosure. Thus, the dryer(s), and in that event the cooler, form one of the conveyors for transferring the products (particles) they contain.

The first and second dryers, and in that event the cooler, may substantially spread parallel to the longitudinal axis of the chassis, one above the other—or one near the other.

The equipment may further include a hot air generator connected to the dryer(s) to make hot air circulate therein and dry the chips—respectively the sawdust. The hot air generator is preferably mounted on the chassis. The hot air generator may include a hollow cylinder body elongated according to a substantially horizontal longitudinal axis. The hot air generator may spread substantially parallel to the longitudinal axis of the chassis, below the dryer(s)—or near it (them). The hot air generator may include a bundle of tubes parallel to its longitudinal axis, a first end of each tube communicating with ambient air, and a second end of each tube communicating with the (second) dryer to make the air heated in the generator circulate therein.

The hot air generator may include a hearth having a shape elongated along its longitudinal axis. The hearth may receive a conveyor for carrying a solid combustible. The solid combustible may consist of wood chips provided by the shredder (or a second shredder).

The unit for the production of hot air may include a duct for carrying air from the cooler to the generator, which is equipped with a fan, a duct for carrying hot air from the generator to the second dryer, and a duct for carrying hot air from the second dryer to the first dryer.

The unit for the production of hot air may include a second shredder.

The shredder(s), the grinder, and the compactor may be arranged on a chassis common to the dryers, the cooler, and the generator, on each side of them.

The hot air production unit may include a separator for retaining cinders and separate them from smoke and combustion gas.

The equipment may include a unit for the production of electrical energy from a combustible, this unit being arranged on the load-bearing structure(s).

The load-bearing structure may include a false chassis which can be removed from a rolling support such as a road trailer, by way of fast unlock fasteners and stabilizing cylinders allowing the false chassis to be lifted and moved away from the rolling support.

The equipment may include a control unit (UC) linked to a weight sensor for continuously weighing shredded wood particles, to a sensor sensitive to the humidity of wood particles, and to a sensor sensitive to the temperature of the dryer(s). The control unit is arranged, in particular programmed, to modify an operating parameter of the unit (LPGcont) for the production of granules, such as the rate of advance of a conveyor (C1, S1, S2, REF) for carrying wood particles, and/or an operating parameter of the unit (GAC) for the production of hot air such as hot air speed or temperature, as a function of signals—or data—provided by the weight sensor, the humidity sensor, and the temperature sensor;

The equipment may include a fire detection and sprinkling control unit, this unit being arranged on the load-bearing structure(s).

Embodiments of the invention make it possible to easily and efficiently process various types of plants, in particular plants for which humidity is around 60 to 75%.

Other aspects, features, and advantages of the invention will be described in the following description in relation with, but not limited to the appended figures which show preferred embodiments of the invention.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

The equipment according to the invention preferably integrates all the elements/components allowing granules to be produced, from the reception of slash, trunks and branches, to the granules packed in bags, big-bags, or in bulk.

Embodiments of the invention allow the equipment for producing granules to be mobile, the compactness and small size of the equipment allowing its components to be integrated on a mobile chassis and/or a road trailer.

Embodiments of the invention make it possible to reduce transport costs while allowing the equipment according to the embodiments of the invention to be installed near a plant collection area, for example in a clearing.

The equipment according to embodiments of the invention may, for example, have a productive capacity of 1 ton of granules per hour.

Figure 1:
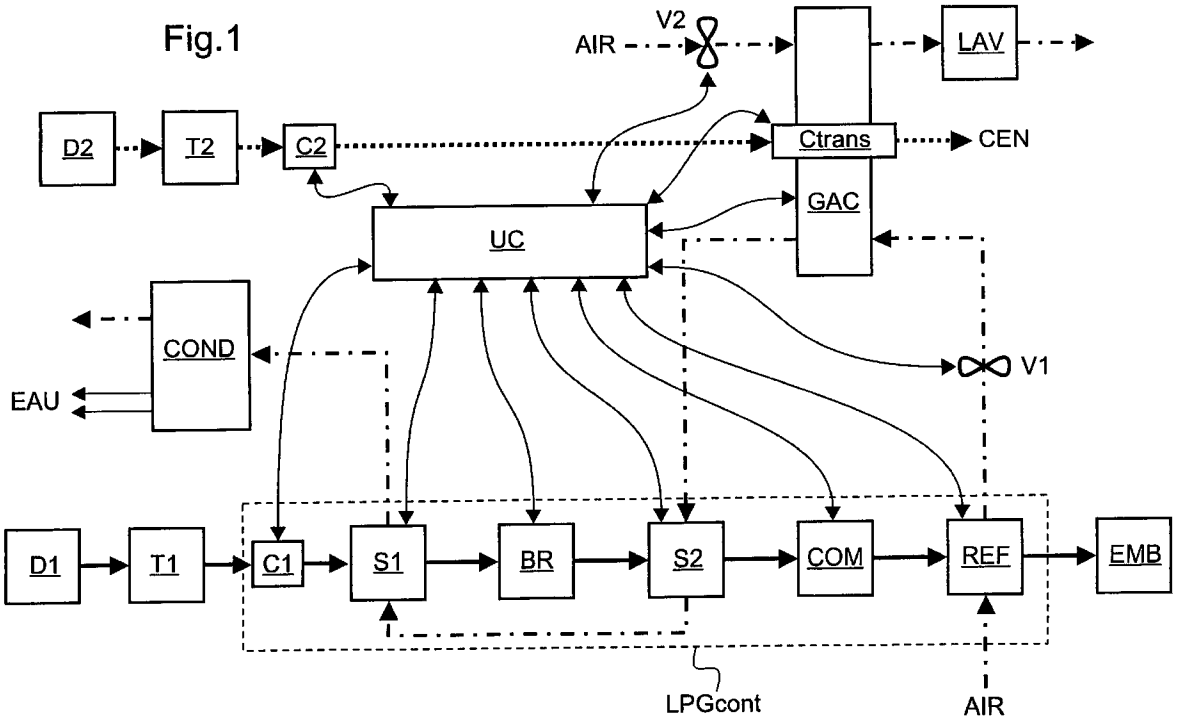
FIG. 1 is a diagram of the equipment according to an embodiment of the invention.

In the diagram shown in FIG. 1, the unidirectional arrows in continuous line represent the flows of wood particles transferred from one element to another, using a transfer element such as a conveyor, or directly—without transfer element, from a first shredder D1 to a station EMB for packing granules.

One—and only one—unidirectional double arrow in continuous line represents the water going out of a condenser COND.

In the diagram shown in FIG. 1, the unidirectional arrows in dotted line represent the flows of wood particles transferred from one element to another, using a transfer element such as a conveyor, or directly—without transfer element, from a second shredder D2 to a station for collecting ashes CEN resulting from the combustion of these particles in the hot air generator GAC.

In the diagram shown in FIG. 1, the unidirectional arrows in chain dotted line represent the flows of air carried from one element to another, under the pulse of a motor element such as a fan V1, V2, the air circulating in particular in carrying ducts or chambers.

In the diagram shown in FIG. 1, the bidirectional arrows in continuous line represent the flows of signals and/or data of measurement, control, and/or command exchanged by a control unit UC and sensors or actuators integrated into the components of the equipment.

Figure 2:
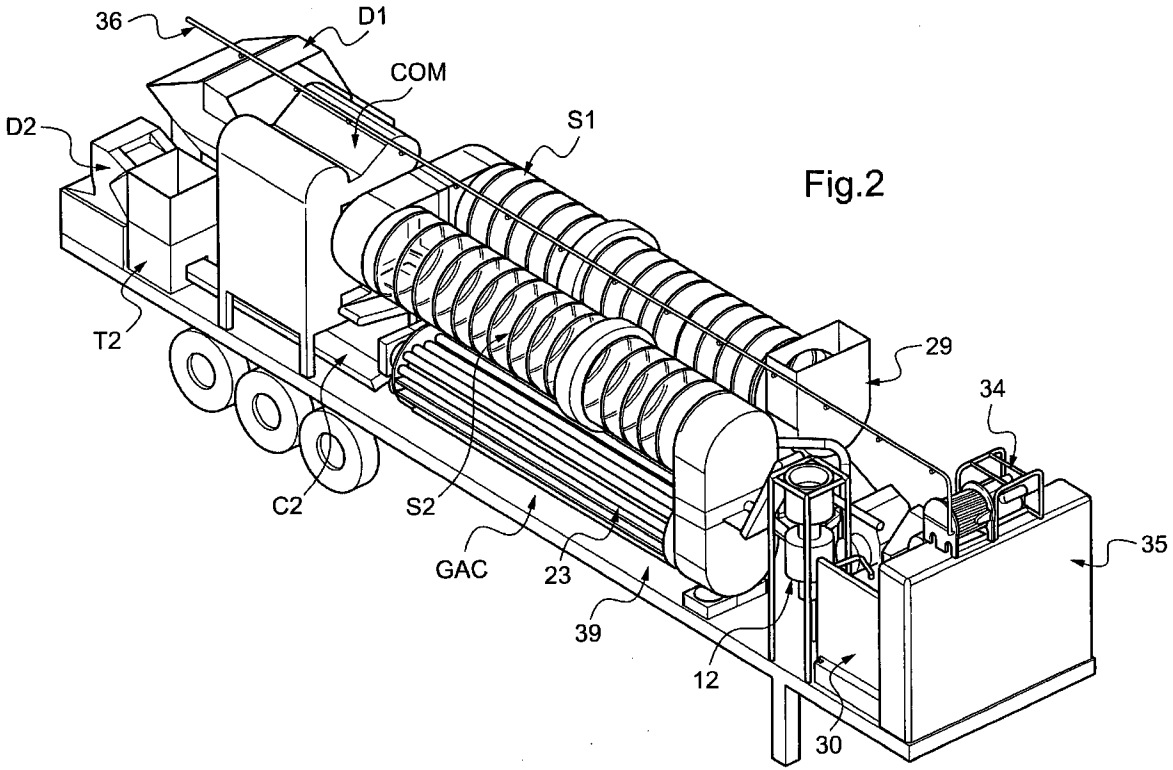
FIG. 2 schematically shows, in perspective, the main components of the equipment according to an embodiment of the invention and the arrangement thereof on a road trailer.
Figure 3:
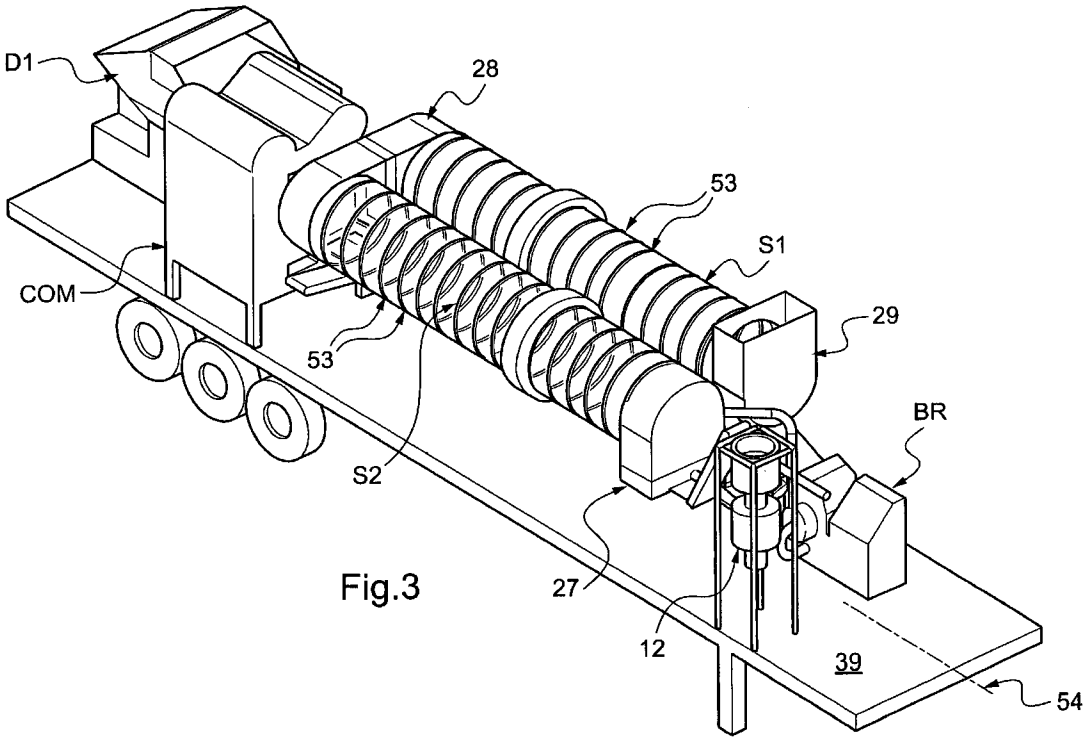
FIG. 3 schematically shows the main components of the equipment shown in FIG. 2 which are part of the unit for producing granules of dried wood sawdust, and the arrangement thereof on the road trailer.
Figure 4:
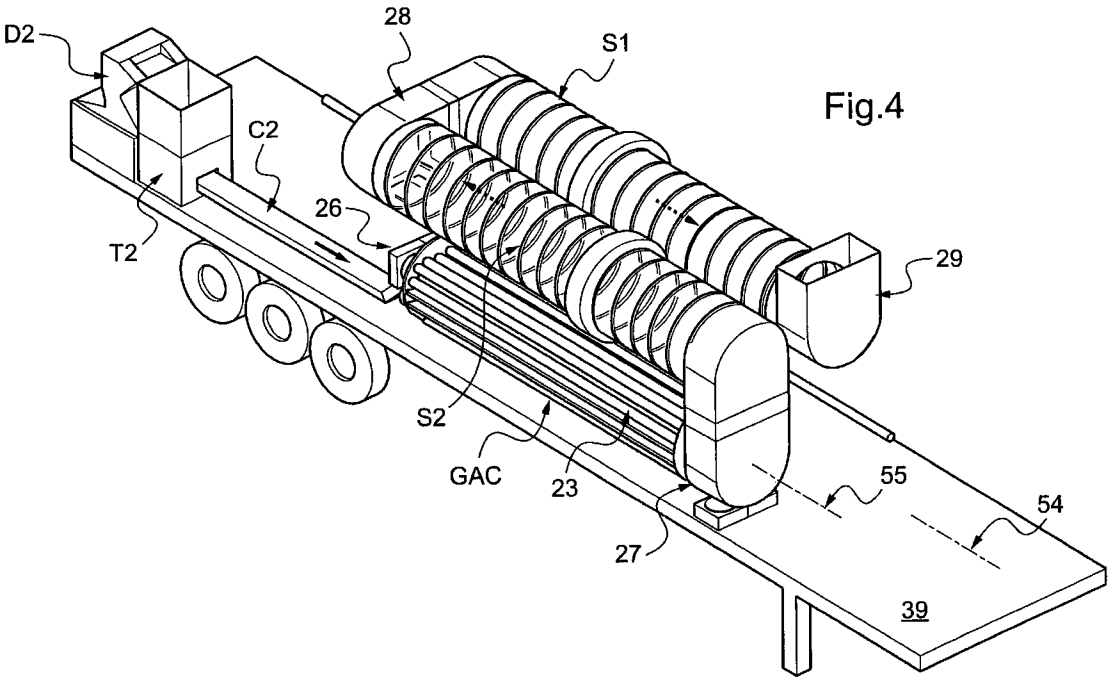
FIG. 4 schematically shows the main components of the equipment shown in FIG. 2 which are part of the unit for producing and carrying hot air used for drying the sawdust and wood chips, and the arrangement thereof on the road trailer.

In FIGS. 2 and 4, the horizontal tubular casing of the hot air generator has not been represented so as to show the elements it contains.

In the same goal, in FIGS. 2 to 5, the horizontal tubular casings of the dryers and the cooler have been represented translucent so as to show the projecting helical structure on the internal face of these casings.

Figure 5:
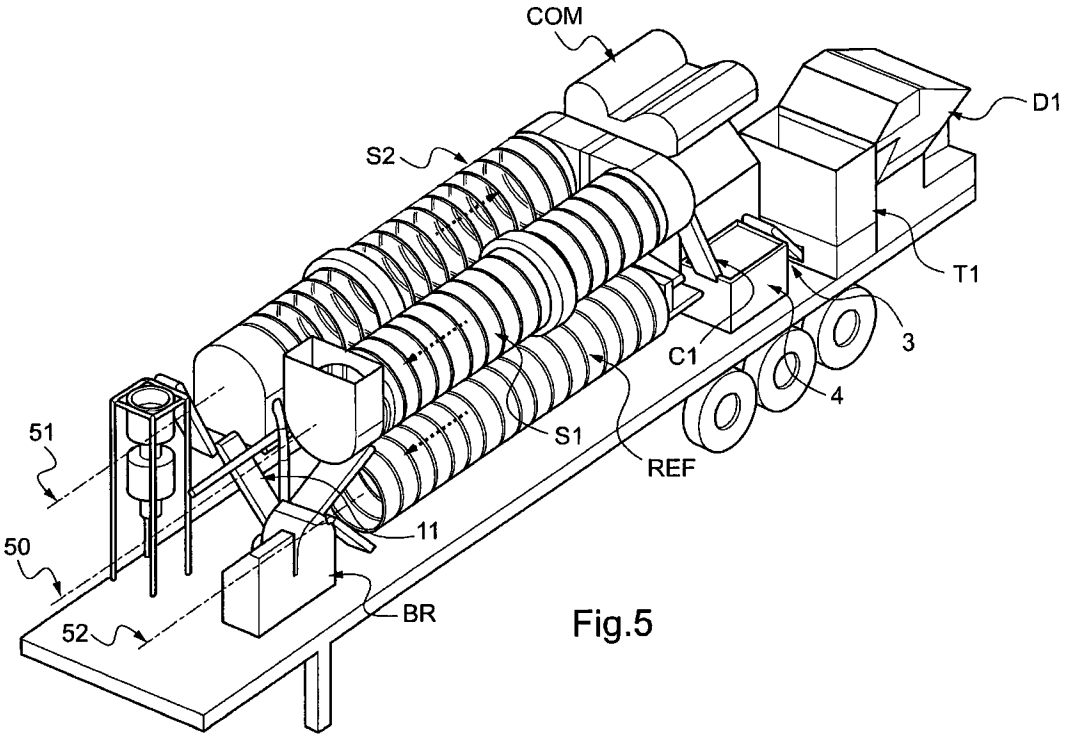
FIG. 5 schematically shows, according to another view angle, the main components of the equipment shown in FIG. 2, which are used to produce granules of dried wood sawdust, and the arrangement thereof on the road trailer.

In FIGS. 4 and 5, the unidirectional arrows without reference, which are respectively parallel to the longitudinal axes of the dryers S1, S2, the cooler REF, and the conveyor C2, indicate the travel direction of the wood particles in/on these elements.

With reference to FIGS. 1 and 2 in particular, the equipment according to an embodiment of the invention includes two shredders operating "in parallel." A first shredder D1 shreds slash and produces chips for the production of granules; a second shredder D2 shreds slash of low value and produces shredded wood used as combustible to produce hot air used to dry the wood particles coming from the first shredder.

Each shredder D1, D2 respectively feeds an intermediate storage container T1, T2.

These intermediate storage containers T1, T2 allow the continuous production of granules to be stabilized, in cooperation with two motorized and regulated conveyors C1, C2, located at the output of these containers, and controlled by the control unit UC.

The shredded wood used for the production of granules must be clean from "impurities" (dust, sand, stones, and the like), to guarantee its quality and avoid damaging the equipment mechanism.

To that end, the wood can be filtered, for example by vibrating and screening, and/or can be separated from impurities by flotation and agitation in a settling basin (reference 4, FIG. 5).

The operations of grinding the chips and agglomerating/granulating sawdust are helped by drying the wood particles which is performed between each step, avoiding "filling" cutting/compacting tools.

Drying the wood particles is performed in two drying tunnels S1, S2 equipped with "worms" and performing four simultaneous actions: conveying, agitating, drying, and containment of wood particles.

Before being conditioned, the granules produced must be cooled; the equipment comprises to that end a cooling tunnel REF (FIGS. 1 and 5) conveying the granules from compacting/granulating to the conditioning station.

The air intended to be heated by the furnace GAC (FIGS. 1, 2 and 4) is "sucked" through the tunnel REF where it is preheated by recovering the calories provided by the granules. Sucking also produces a depression helping to cool the granules.

The components of the mobile equipment according to an embodiment of the invention, in particular the dryers, the cooler and the generator GAC are arranged on a common chassis 38, 39 so as to create, for hot air and wood particles, a "zigzag" travel according to a "back and forth" pattern. This arrangement allows the inputs and outputs of the elements performing the successive operations of the process method to be brought nearer.

The heated air circulates from one tunnel to another thanks to transfer chambers/ducts which channel the air with little loss. This configuration allows one hot air current to be used.

Although the hot air required for drying can be produced by a conventional generator operating on gas, fuel oil, or electrical energy, hot air is advantageously produced by a furnace (GAC) in which slash of low value is burnt.

The hot air generator includes an air carrying structure having a bundle of tubes, which is heated by the source of heat and which isolates the air it carries from this source, so as to avoid carrying flammable particles or compounds.

This furnace has an elongated shape and dimensions which are near those of the three conveyor tunnels S1, S2, REF, which helps the integration side by side of these compounds onto a common mobile chassis.

So as to avoid cinders produced by the furnace GAC from being susceptible of causing fires, the smoke exhaust duct of the generator GAC may be equipped with a separator LAV for example performing cyclonic sucking and centrifugal water film.

The residual humidity of the wood particles varies, from a drying tunnel to the other, in particular according to the conveying speed of wood particles in the tunnels.

For example, for an air temperature of around 350° C. and an air circulating speed in the tunnels of around 0.5 m/s, the transit time of wood particles in each tunnel may be around one hour.

The conveying speed of particles in the tunnels may be set by the unit UC controlling the tunnels driving motors, to guarantee a residual humidity of the granules in a range comprised between around 10% to around 15%, and thus help granule cohesion.

According to one embodiment, the conveying speed of the chips in the first dryer S1 is adjusted to guarantee a relative humidity of dried chips of around 20%, which then allows dried chips to be finely grinded without causing filling, and the conveying speed of sawdust in the second dryer S2 is adjusted to guarantee a relative humidity of dried sawdust of around 8 to 12%, which facilitates the subsequent compaction thereof.

The equipment according to an embodiment of the invention is preferably equipped with an electrical generator powering the elements (grinders, compactor, tunnels) of the equipment.

The electrical energy is produced by a generator using the heat generated by the furnace, for example in the form of water vapor.

The chassis of the equipment is equipped with platforms facilitating maintenance and troubleshooting operations at "shoulder height". These platforms equipped with guardrails may be retractable to limit the width of the equipment to the road clearance.

The granule conditioning elements are adapted to the format of the desired packing, or to the transfer by blowing to a storage container in bulk installed on a truck or a second trailer.

The load-bearing structure 38, 39 of the equipment comprises a retractable platform of the tailgate type, placed at one end of the chassis, to facilitate handling and packing operations.

The equipment according to the invention may comprise a fire suppression system mainly consisting of a stock of water, a pump and a sprinkling circuit. The pump may be driven by a thermal motor and connected on the one hand to a semi-rigid hose-reel, on the other hand to sprinklers.

The stock of water may be used to feed the settling basin, the smoke washer, and the fire suppression system.

All the elements of the equipment according to an embodiment of the invention may be fixed onto a false chassis 39 (FIG. 7) which may be fixed onto a trailer 38 (FIG. 8) or a truck.

The false chassis may be equipped with stabilizing feet 40 (FIG. 7) the support surface of which is wide enough to avoid sinking into the ground.

The false chassis can be removed from its rolling support, thanks to fast unlock fasteners and stabilizing cylinders allowing it to be lifted and moved away from its rolling support, a trailer for example. The fact that the equipment can be removed from its support allows the mobile support to be used for other purposes.

On the contrary, for small duration operations, the equipment according to the invention may be operated on its mobile support. In that case, the tires may be protected from heat by thermal shields.

With reference to FIGS. 1 to 3 and 5 in particular, a part of the equipment forms a unit—or line—LPGcont for the continuous production of sawdust granules; this unit includes a shredder D1 which reduces the slash and trunks of a section lower than 25 cm for example, into disintegrated or average chips, for example from 10 to 15 mm of thickness.

A discharge ramp of the shredder D1 opens onto an intermediate storage container T1, the volume of which may be around 1 $m^3$, i.e. around 30 minutes of consumption of the line LPGcont.

Disintegrated wood is partially extracted from this sink by a conveyor 3 (FIG. 5) the rate of advance of which is adjusted to the desired productive capacity by the unit UC.

The conveyor 3 feeds a sedimentation tank 4 equipped with an agitator (not shown) which precipitates the dense particles (stone, sand, metals, and the like) to separate them from the chips.

The sedimentation tank has a worm (not shown) scraping the bottom to evacuate dense particles.

An open work conveyor C1 used as drainer transfers the chips to the first drying tunnel S1.

The dryer/conveyor tunnel S1, which is substantially identical to the tunnels S2 and REF, includes a conveying worm conveying and agitating the wood particles.

To that end, the dryers S1, S2, and the cooler REF each include an elongated hollow cylinder body rotatively mounted according to their respective horizontal longitudinal axes 50, 51, 52. Each hollow body delineates a tubular transfer enclosure able to contain the chips—or the sawdust—to be dried, respectively the granules to be cooled.

The internal face of the wall of the hollow body is provided with projecting portions 53 (FIG. 3) spreading along a line in helix which axis is substantially the same as the longitudinal axis of the hollow body, these projecting portions make it possible to cause, by the rotation of the hollow body according to its axis, the transfer along this axis of the particles—chips, sawdust, or granules—contained in the tubular enclosure.

The dryers and cooler spread substantially parallel to the longitudinal axis 54 of the chassis, one above the other—or one near the other.

The length of the cylinder hollow body (or drum) of the dryers and its adjustable rotation speed allow the transit time and therefore the drying duration to be set.

The first tunnel S1 opens onto a refining grinder BR (FIGS. 3 and 5) reducing the dried shredded wood chips into particles which thickness may be around 1 to 2 mm, which are considered as sawdust.

The output of this grinder is equipped with a cyclone with exhaust duct introducing the sawdust into the second tunnel S2.

The tunnel S2 agitates and dries sawdust at an adjustable temperature from 200 to 700° C., and conveys it up to the granulator/compactor COM.

The compactor COM is equipped with compression rollers and can agglomerate sawdust into granules from 8 to 10 mm of diameter and 15 to 20 mm of length, for example.

A discharge ramp of the compactor introduces the granules into the cooling tunnel REF.

The tunnel REF agitates the granules and cools them by evacuating the calories by contact with the air sucked by the fan V1. The air sucked circulating against the granules cools them efficiently and separates dust from the granules—and brings dust with it.

The tunnel REF opens onto a dispenser allowing the conditioning to be selected by means of a rotating deflector (not shown) manually operated for example, which makes it possible to direct the granules, into a bag-filling machine 12, or in a "Big-Bag."

The bag-filling machine 12 (FIG. 3) may include a "dosing silo" calibrating the volume of the bag and can automatically perform the calibration, filling and closing operations.

The handling platform 13 is part of the conditioning station EMB allowing an operator to perform/control several additional operations: shaping and closing the bags, filling in a first bag controlled by a weighing machine so as to calibrate filling-in, the weighing machine being integrated to a support frame of the station EMB; preparing and supporting a second bag receiving the granules after filling in the first bag.

A handling arm equipped with a handling element with a suction cup may be provided to help the operator stacking the bags onto a pallet.

A rotating plate 15 (FIG. 7) receiving a pallet allows the pallet to turn on itself to be wrapped, once loaded with granule bags. To that end, a column for applying plastic film performs the rotating movement of the plate 15 and moves a plastic film roll from the top to the bottom.

With reference to FIGS. 1, 2, 4, and 5 in particular, a second part of the equipment forms a unit—or line—for the production of hot air.

This unit comprises the second shredder D2 of a capacity lower than that of the shredder D1, which reduces slash into disintegrated chips.

A discharge ramp of this shredder opens onto the intermediate storage container T2 allowing the heat energy produced by the furnace to be stabilized.

Disintegrated wood is extracted, in the lower part of this container T2 by a conveyor C2, to feed the furnace.

The rate of advance of the conveyor C2 is adjusted by the unit UC to maintain the temperature of the drying air going out of the furnace at a value for example near 350° C., in particular at a value slightly lower than 350° C. when the plants to be dried contain easily flammable compounds.

With reference to FIGS. 2 and 4 in particular, the furnace/generator GAC is connected to the dryers to make hot air circulate therein and dry the chips—respectively sawdust.

The hot air generator includes a hollow cylinder body elongated according to a horizontal longitudinal axis 55 (FIG. 4) parallel to the longitudinal axis 54 of the chassis, below the dryers and along the cooler REF.

The hot air generator includes a bundle 23 of tubes parallel to its longitudinal axis, a first end of each tube communicating with ambient air, and a second end of each tube communicating with the second dryer to make the air heated in the generator penetrate therein.

The hot air generator includes a hearth which shape is elongated along its longitudinal axis, the hearth receiving a carrying conveyor Ctrans which spreads parallel to this axis, which passes through the generator GAC and receives the shredded wood provided by the conveyor C2.

The conveyors C2 and Ctrans allow the intermediate storage T2 of the furnace to be isolated to avoid transmitting the fire.

The conveyor Ctrans moves "back and forth" respectively to distribute the combustible on the whole length of the hearth, by its upper face, and scrap ashes CEN to evacuate them, by its lower face.

The conveyors C2 and Ctrans are driven by the control unit UC with the same rate of advance.

The furnace GAC has in its lower part, on its whole length, a combustion chamber. This chamber has holes spaced out at equal distance from one another to stir up the fire, through the conveyor which moves the combustible.

An activation fan V2 pulsates fresh air into the combustion chamber at a speed optimizing the combustion of slash and reducing the volume of ashes.

The drying air fan V1 feeds the "organ" or bundle 23 of longitudinal tubes offering a great surface of thermal exchange, which is placed in the higher part of the furnace.

The smokes produced by the furnace are channeled into a stack which evacuates them in the upper part of the equipment.

The cinders carried away with the smoke are eliminated and precipitated by a separator (washer) LAV. The washer and the fan V2 may be connected to a common drive shaft.

Extracting the smoke is performed in a chamber located above the organ, on the whole length of the furnace.

The fan V1 located at the output of the tunnel REF, sucks the air preheated in the tunnel, producing a depression helping to cool the granules.

A transfer chamber 26 includes the fan V1 injecting air into the furnace organ.

A transfer chamber 27 channels the hot air coming out from the organ of the furnace GAC to the tunnel S2.

A transfer chamber 28 channels the hot air coming out from the tunnel S2 to the tunnel S1. In its lower part, the chamber is provided with a hatch for evacuating sawdust to feed the compactor COM.

A chamber 29 evacuates the hot and humid air from the tunnel S1 toward outside, through a condenser COND. In its lower part, the chamber is provided with a hatch for evacuating shredded wood to feed the refining grinder BR.

Figure 6:
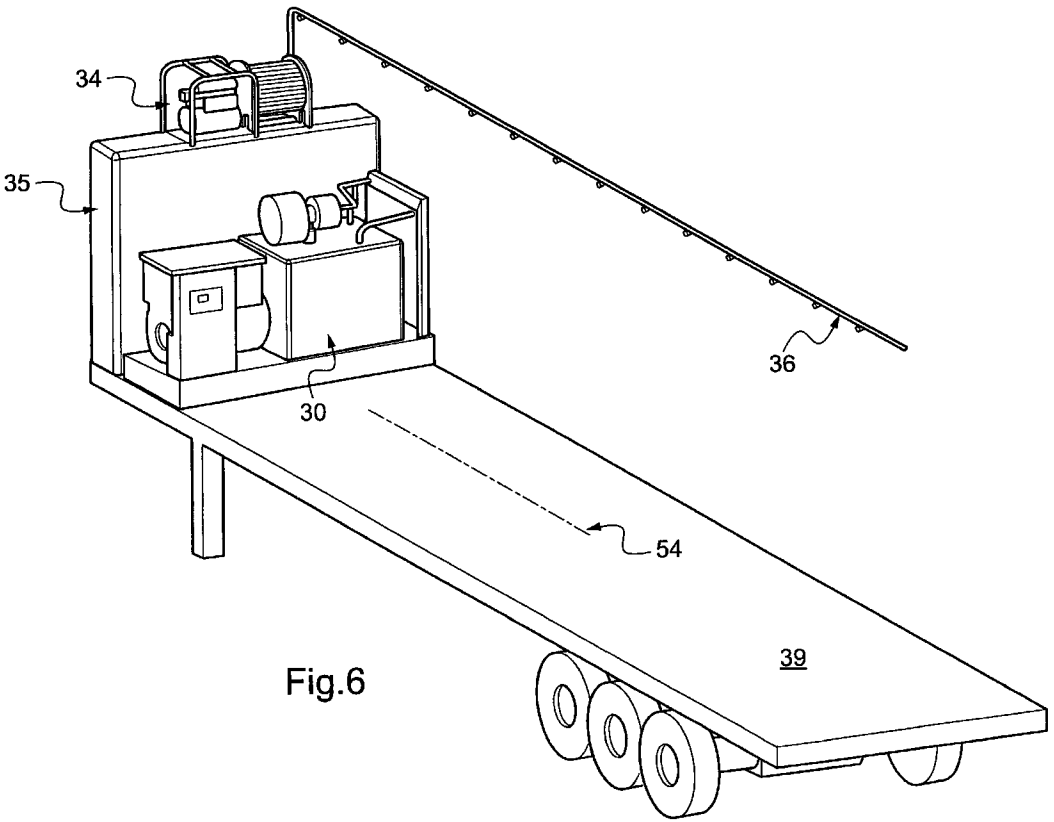
FIG. 6 schematically shows, according to another view angle, the main components of the equipment shown in FIG. 2, which are used to produce electrical energy and to sprinkle the equipment in the event of fire, and the arrangement thereof on the road trailer.

With reference to FIGS. 2 and 6 in particular, another part of the equipment forms a unit for the production of electrical energy, which includes a generator set 30 powering the equipment elements, and a fuel tank.

A control panel (not shown) linked to the control and command electronic unit UC displays: an overview diagram of the equipment identifying the location of the electrical elements and their controls; the safety indicators (temperature, water level, fuel level, faults); the electronic measurement results (weight of the materials processed at the input and the output in particular).

The production regulating automatism UC controls the rates of advance of the conveyors and tunnels so as to maintain the productive capacity per hour at the desired value.

For the granule production line LPGcont, the rate of advance may be slaved at the continuous weighing of shredded wood, measured on the conveyor C1 at the output of the sedimentation tank.

For the line of hot air production, the rate of advance may be slaved at the drying air temperature, in particular during transient phases of starting and stopping the equipment.

Regulating the drying air temperature allows a regular temperature to be maintained in the drying tunnels S1 and S2.

In parallel, the humidity rate required for good granule cohesion is measured in sawdust before compacting, by measuring the electrical conductivity of sawdust between metal electrodes in contact with the sawdust contained in the tunnel S2.

Maintaining this humidity rate in a range of desired values may for example be obtained by driving a power-operated valve for setting the evacuation of water vapor contained in the tunnel S2, and/or by automatically varying the temperature setpoint in the tunnel(s), and therefore the temperature of the drying air produced by the furnace.

With reference to FIGS. 2 and 6 in particular, another part of the equipment forms a fire safety unit comprising a tank 35, a pump 34 and a sprinkling device 36.

The pump 34 may supply a water discharge rate of around 250 l/mn under a pressure around 6 bars to simultaneously feed one or more ramps of sprinklers, if need be with the injection of an additive.

A water tank 35 of a volume around 3 $m^3$ may be divided to avoid unbalance during the equipment travel.

Ramps equipped with sprinkling nozzles 36 may be fed by manual valves or electrically-operated valves controlled by thermal sensors.

Figure 7:
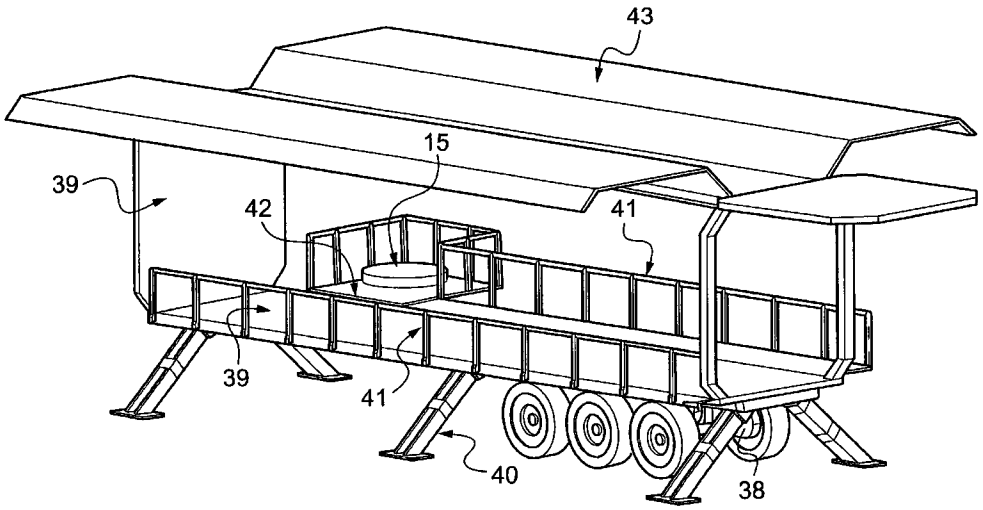
FIG. 7 schematically shows, according to another view angle, the load-bearing and casing structure of the equipment shown in FIG. 2, which is used to support and enclose the compounds of the equipment, and which comes in the form of a trailer, or a false chassis susceptible of resting on a trailer.
Figure 8:
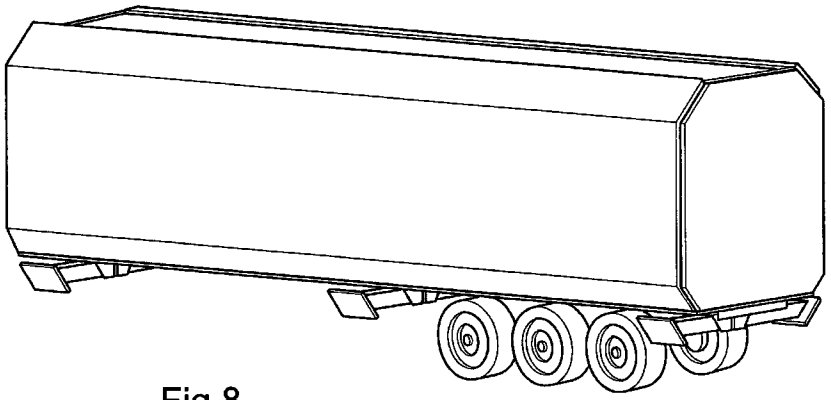
FIG. 8 schematically shows the structure of the equipment shown in FIG. 7, which casing panels are in a closing configuration, and which stabilizing legs are in a retracted configuration allowing the equipment to be towed by a towing vehicle.

With reference to FIGS. 7 and 8 in particular, the equipment comprises a chassis 38 of road trailer which bears the granule production unit, the hot air production unit, as well as the energy production and fire safety units, by means of a false chassis 39 which receives all the intermediate devices and load-bearing structures (frames or the like). A system for locking the false chassis on the trailer allows the false chassis bearing the equipment to be put down and the trailer to be used for other purposes.

This false chassis is provided with hydraulic cylinders 40 allowing it to rest stable on the ground. The stabilizers 40 may be coupled one to the others by a central part to make the load uniform and correct the attitude of the equipment.

The false chassis is encircled by retractable platforms 41 for maintenance operations. The platforms have guardrails and access stairs. The set folds up vertically to match the road clearance.

A tailgate 42 constitutes a conditioning platform provided with guardrails and a retractable access stairway.

The tailgate comprises a turning plate 15 receiving a loading pallet for granule bags. The rotation of the plate allows a plastic film to be easily put on the pallet.

The structure comprises lateral canopies 43 which can be horizontally spread by cylinders to shelter operators and equipment from bad weather.

They may be used as intake areas when, as shown in FIG. 7, their surfaces lean toward the centre of the equipment the central part of which may include a through for collecting rainwater feeding the fire safety tank.

The canopies may include a circuit for the condensation of water vapor produced by drying wood particles. For example, the canopy walls may include a sandwich of 2 metal plates, one of which has a series of slanted folds, helping vapor condensation—in addition to strengthening the canopy, water flowing and collecting at the end of the canopy front and back.

Feeding the canopies with water vapor may be made by the middle of the canopies, thus defining 4 condensation areas.

The water vapor condensated in the canopies, in particular when the canopies are also in the position shown in FIG. 7, may be used to fill in the water tank and/or feed the washer and the settling basin.

FIG. 1 shows in particular that the dryer S1, the grinder BR, the dryer S2, the compactor COM, and the cooler REF are arranged and connected two by two in this order, in "series," for the continuous process of the chips provided by the shredder D1. FIG. 1 also shows that the cooler REF, the generator GAC, the dryer S2, and dryer S1 are arranged and connected two by two in this order, in "series," for drying the wood chips and conveying air against the flow of wood particles.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. Equipment for processing a ligneous material comprising:

a unit for the production of agglomerated particles of the ligneous material, a unit for the production of hot air being used for drying particles of the ligneous material, and at least one mobile load-bearing structure to which the two production units are attached, the unit for the production of agglomerated particles comprising a first dryer able to dry chips, a grinder arranged to grind chips dried by the first dryer and to provide sawdust, a second dryer arranged to dry the sawdust produced by the grinder and provide dry sawdust, and a compactor arranged to compact the sawdust dried by the second dryer and provide granules of dry sawdust, the unit for the production of hot air comprising a hot air generator connected to the first and second dryers to make hot air circulate therein and dry the chips and sawdust, the hot air production unit producing hot air from the ligneous material, the hot air generator comprising a bundle of tubes communicating with the dryers to make the air heated in the generator circulate therein.

2. Equipment according to claim 1, wherein the at least one load-bearing structure comprises a chassis arranged to rest on the ground, through stabilizing feet or wheels.

3. Equipment according to claim 1, wherein the first dryer is arranged to perform a substantially continuous transfer of dried chips to the grinder, wherein the grinder is arranged to perform a substantially continuous transfer of sawdust to the second dryer, and wherein the second dryer is arranged to perform a substantially continuous transfer of dry sawdust to the compactor.

4. Equipment according to claim 1, wherein the unit for the continuous production of agglomerated particles further comprises a shredder able to shred slash, trunks, or branches to produce chips, the shredder being arranged to provide chips to the first dryer.

5. Equipment according to claim 1, wherein the unit for the continuous production of agglomerated particles further comprises a granule cooler which is fed by the compactor and is arranged to provide cooled granules to a packing station, the packing station being mounted on the at least one load-bearing structure.

6. Equipment according to claim 1, wherein the dryers and a cooler spread substantially parallel to the longitudinal axis of the at least one load-bearing structure, and wherein the hot air generator comprises a hollow cylinder body elongated according to a substantially horizontal longitudinal axis, and spreads substantially parallel to the longitudinal axis of the at least one load-bearing structure, along the dryers and the cooler.

7. Equipment according to claim 1, wherein the bundle of tubes of the hot air generator extends parallel to the longitudinal axis thereof, a first end of each tube communicating with ambient air, and a second end of each tube communicating with the dryers to make the air heated in the generator circulate therein.

8. Equipment according to claim 1, wherein the hot air production unit comprises:

a duct for carrying air from a cooler to the hot air generator, which is equipped with a fan, a duct for carrying hot air from the generator to the second dryer, and a duct for carrying hot air from the second dryer to the first dryer.

9. Equipment according to claim 4, wherein the hot air production unit comprises a second shredder arranged to provide chips to the generator.

10. Equipment according to claim 1, wherein the hot air production unit comprises a separator for retaining cinders and separate the cinders from smoke and combustion gas produced by the generator.

11. Equipment according to claim 1, which further comprises a unit for the production of electrical energy from the heat produced by the generator, the unit being arranged on the at least one load-bearing structure.

12. Equipment according to claim 1, wherein the at least one load-bearing structure comprises a false chassis removable from a rolling support, by way of fast unlock fasteners and stabilizing cylinders allowing the false chassis to be lifted and moved away from the rolling support.

13. Equipment according to claim 1, further comprising a control unit linked to a weight sensor for continuously weighing shredded wood particles, to a sensor sensitive to the humidity of the wood particles, and to a sensor sensitive to the temperature of at least one of the first or second dryers, the control unit being arranged, in particular programmed, to modify an operating parameter of the unit for the production of granules, and/or an operating parameter of the unit for the production of hot air, as a function of signals—or data—provided by the weight sensor, the humidity sensor, and the temperature sensor.

14. Equipment according to claim 13, wherein the operating parameter of the unit for the production of granules is a rate of advance of a conveyor for carrying wood particles.

15. Equipment according to claim 13, wherein the operating parameter of the unit for the production of hot air is at least one of hot air speed or temperature.

16. Equipment according to claim 1, which further comprises a fire detection and sprinkling control unit, this unit being arranged on the at least one load-bearing structure.

* * * * *